United States Patent [19]

Goto

[11] Patent Number: 4,722,291

[45] Date of Patent: Feb. 2, 1988

[54] APPARATUS FOR AUTOMATICALLY ADJUSTING THE STITCH PITCH OF A SEWING MACHINE

[75] Inventor: Sumio Goto, Chofu, Japan

[73] Assignee: Tokyo Juki Industrial Co., Ltd., Tokyo, Japan

[21] Appl. No.: 826,819

[22] Filed: Feb. 6, 1986

[30] Foreign Application Priority Data

Feb. 8, 1985 [JP] Japan ..... 60-23075

[51] Int. Cl.[4] ..... D05B 27/22

[52] U.S. Cl. ..... 112/315; 112/272; 112/275; 112/121.11

[58] Field of Search ..... 112/121.11, 272, 275, 112/315, 121.12, 277, 262.1, 2, 314

[56] References Cited

U.S. PATENT DOCUMENTS 4,495,877 1/1985 Willenbacher ..... 112/121.11
4,528,923 7/1985 Hager ..... 112/275
4,545,310 10/1985 Treadwell et al. ..... 112/315 X
4,587,915 5/1986 Wenz et al. ..... 112/275
4,602,577 7/1986 Kothe et al. ..... 112/275 X

FOREIGN PATENT DOCUMENTS 53-38646 10/1978 Japan .

*Primary Examiner*—Peter Nerbun
*Attorney, Agent, or Firm*—Morgan & Finnegan

[57] ABSTRACT

An automatic stitch pitch adjusting apparatus for a sewing machine allows the last stitch point to be terminated at a pre-set point. Three workpiece-end sensors are positioned respective a needle hole position to precisely calculate the required actual stitch line length. Reference signals generated by rotation of a main shaft are used to calculate both the required number of stitchings and the adjusted stitch pitch to terminate stitching at the pre-set point. Where the workpiece end line is not normal against the feeding line, the pre-set margin distance is adjusted to calculate the actual required stitching line length to the last pre-set point.

13 Claims, 9 Drawing Figures

15a: ACTUATOR
16: CONNECTING LEVER
17: CAM BODY
17a: CAM SURFACE
19: POTENTION METER
23: FIRST CALCULATING MEANS
23a: EXOR GATE
23b: AND GATE
24: SECOND CALCULATING MEANS
24a: INVERTER
24b, 24c: AND GATE

APPARATUS FOR AUTOMATICALLY ADJUSTING THE STITCH PITCH OF A SEWING MACHINE

BACKGROUND OF THE INVENTION

The invention relates to an automatic stitch pitch adjuster for a sewing machine. More particularly, the invention relates to a method and apparatus for automatically adjusting the stitch pitch of a sewing machine in situations where the end of the workpiece is not in a normal line but rather may be slanted against the direction of feeding.

As an example of an automatic stitch pitch adjusting device, Japanese patent publication No. 53-38646 is known. In this reference, the predetermined total stitch line consists of multiple stitching with a predetermined stitch pitch and multiple stitching with an adjusted stitch pitch, the adjusted stitch pitch being shorter than the predetermined stitch pitch.

In the known prior art, since the adjusted stitch pitch was predetermined, it was impossible to terminate the last stitch point at a predetermined point unless the first stitch position is positioned at a predetermined point. Further, since the elasticity of a workpiece may not always be constant, then the margin distance may not be kept constant.

Objects of the invention, therefore, include providing a method and apparatus for a sewing machine for terminating the last stitch point at a predetermined position regardless of the first stitch position and providing a method and apparatus for stitching along the end of a workpiece keeping the margin distance constant.

SUMMARY OF THE INVENTION

To solve these and other objects of the invention, an apparatus for automatically adjusting the stitch pitch of a sewing machine is provided comprising three end detectors for detecting the end of a workpiece, the three end detectors being positioned as follows: a first detector is positioned on a line drawn from a needle hole forward in parallel with the feeding line; a second detector is positioned on a line drawn from the first detector normally to the line connecting the needle hole and the first detector; and a third detector is positioned between the needle hole and the first detector. A reference signal generator is also provided, this generator being synchronized with rotation of the main shaft. A first counting means counts reference signals during the time from when the workpiece passes over the second detector until it passes over the first detector; a second counting means counts reference signals during the time from when the workpiece passes over the first detector until it passes over the third detector. A first operating means is provided to determine the required total stitch length after the third detector has detected the end of the workpiece; a second operating means is provided to calculate the fractional (decimal) portion of the stitch pitch. Operating means are also provided for calculating the required total stitch line length after the third detector has detected the end of the workpiece, referring to the count number obtained by the first and the second operating means. A second driving means feeds the workpiece with the fractional (decimal) stitch pitch.

BRIEF DESCRIPTION OF THE DRAWINGS

The invention will be described in greater detail below by way of reference to the accompanying drawings, in which.

DETAILED DESCRIPTION OF THE DRAWINGS

Referring to the accompanying drawings of FIG. 1 to FIG. 7, one embodiment of the present invention is explained hereafter.

Figure 2:
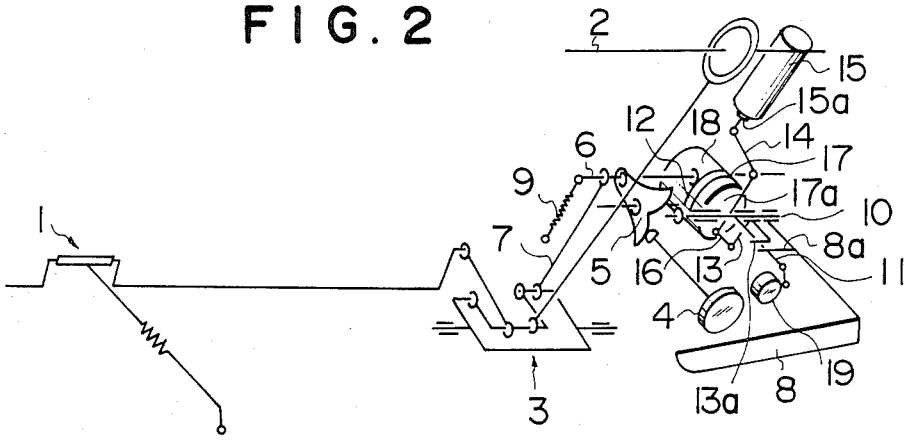
FIG. 2 illustrates an apparatus for adjusting the stitch pitch in accordance with one embodiment of the invention.
Figure 3:
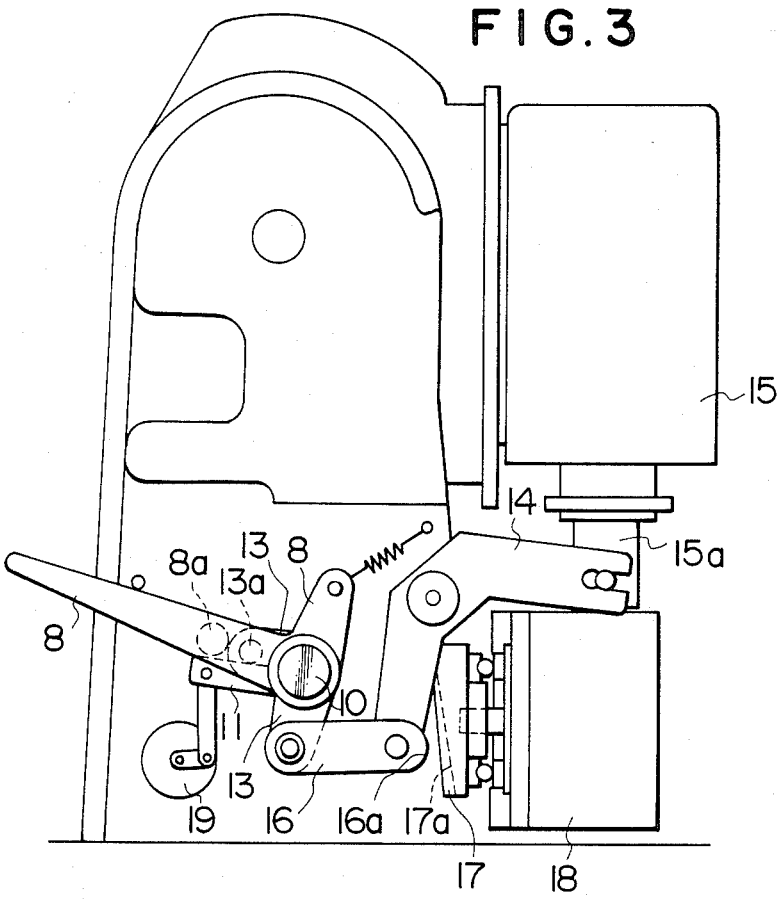
FIG. 3 is a detailed illustration of certain portions of the apparatus of FIG. 2.

Referring to the embodiment of FIG. 2 and FIG. 3, numeral 1 denotes a conventional dog feed mechanism which is located under a bed and causes the dog feed to perform arcuate motion, and thus the dog feed repeats an "appear-disappear" motion above a throat plate in relation to predetermined timing.

Also illustrated in FIG. 2 is a main shaft 2, a conventional stitch pitch adjuster 3 which is connected to the main shaft 2 via a crank rod, a stitch pitch adjusting screw 4 which is rotatable to advance or retract its tip, and a conventional adjusting cam 5 which is rotated around a shaft as a tip of the adjusting screw 4 advances or retracts against the surface of the adjusting cam.

Numeral 6 denotes a rocking shaft fixed to the back end of the adjusting cam 5. A connecting rod 7 is connected between the rocking shaft 6 and the stitch pitch adjuster 3 and adjusts the stitch pitch by changing the horizontal component of motion at the feed adjuster 3 in relation to the position of the cam 5.

Numeral 8 denotes an L-shaped feed lever which has a short arm and a longer arm, and which is urged to move upward by a spring 9 which is stretched between the machine frame and the feed lever 8. The base portion of the feeding lever 8 is sustained rotatably at an adjusting shaft 10 which is pivoted to the machine frame. A pin **8*a* is fixed to the longer arm of L-shaped feeding lever 8**.

Numeral 11 denotes a rocking arm having one end fixed to the adjusting shaft 10 and another end contacting the bottom of the pin **8*a*. The rocking arm 11 is further connected to a potentiometer 19 via a link, and rotates counter-clockwise when the feed lever 8 rotates counter-clockwise, and in such case the adjusting shaft 10** rotates counter-clockwise.

Numeral 12 denotes a connecting arm which connects the control shaft 10 with the rocking arm 6. Depending on the rotational angle of the adjusting shaft 10, the feed is reduced or reversed.

Numeral 13 denotes an L-shaped lever supported rotatably by the adjusting shaft 10. One end of the L-shaped lever 13 provides a pin 13*a* which projects to the upper side of the rocking arm 11, while the other end of the lever 13 is connected rotatably (linked) to one end of a connecting lever 16. An operation lever 14 is nearly L-shaped and its middle portion is supported rotatably by the machine frame. One end of lever 14 is connected rotatably to another end of a connecting lever 16, while the other end of lever 14 is supported by an actuator 15*a* of a solenoid 15.

Numeral 16 denotes a connecting lever which connects the L-shaped lever 13 with the operation lever 14, these connections being rotatably linked. When the actuator 15*a* moves up and down, the connecting lever 16 moves right and left.

Numeral 17 denotes a cam body which is facing against the end 16*a* of the connecting lever 16 and regulates the feed. Numeral 17*a* denotes a cam surface and is fixed pivotably to a shaft of a stepping motor 18. The thickness between the surface of the cam 17*a* and the other end of the cam body differs according to the circumferential position. Accordingly, the distance between the lever end 16*a* and the cam surface differs as per rotational angle of the cam body 17. When the connecting lever 16 moves to the right, the rocking arm 11 rotates counter-clockwise and the feed is reduced.

In the embodiment illustrated in FIGS. 2 and 3, stepping motor 18 regulates the rotational angle of the cam body 17. A potentiometer 19 converts the angular rotation of the rocking arm 11 into electrical signals. During the time when the solenoid 15 is off, the potentiometer 19 detects the feed adjusted by the adjusting screw 4.

Figure 1A:
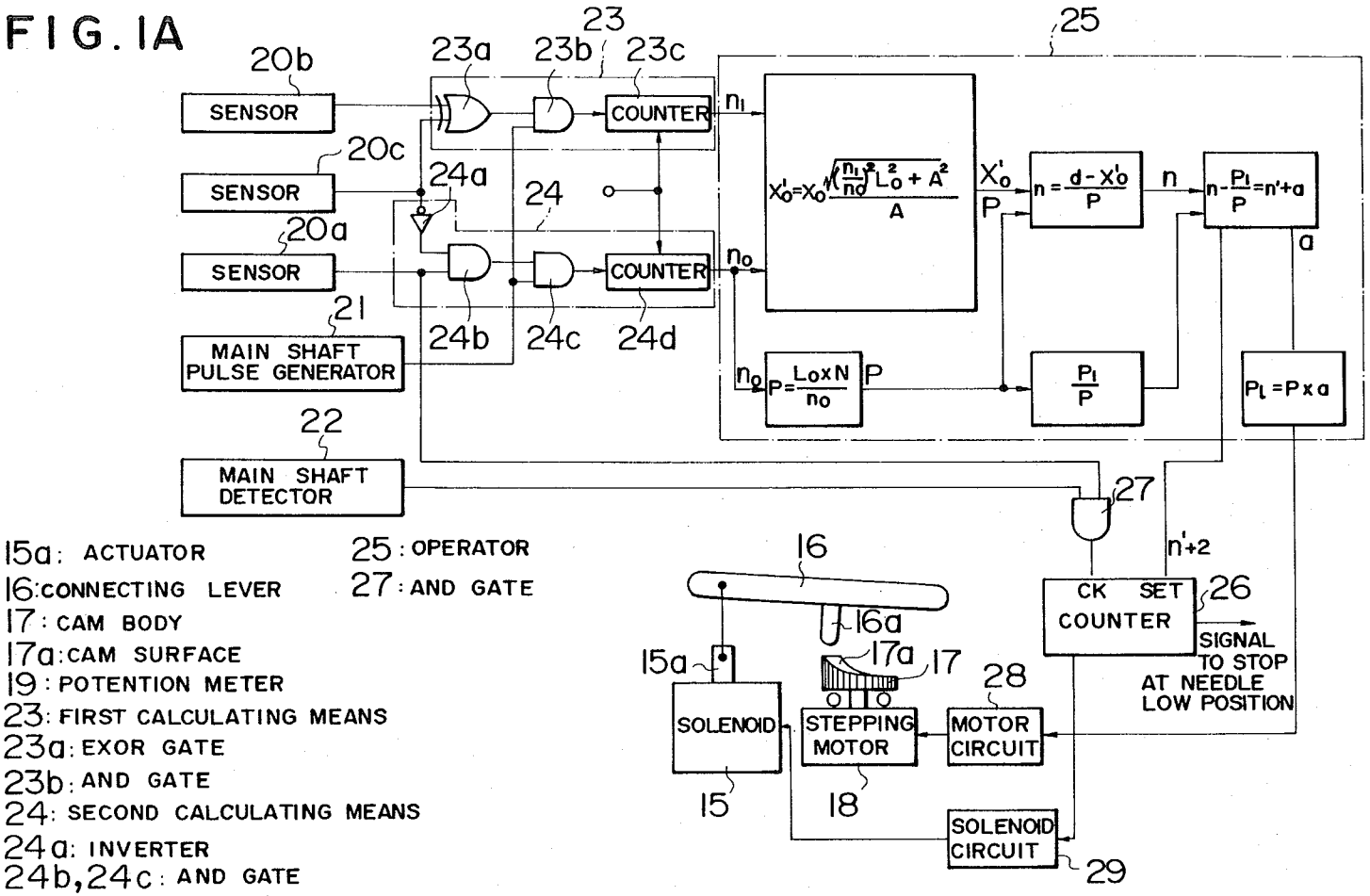
FIG. 1A is a control block diagram according to one embodiment of the invention.

Referring to FIG. 1A, numerals 20*a*, 20*b*, 20*c* denote three photo sensors for detecting the end of the workpiece. Photo sensors 20*a*, 20*b*, 20*c* may each comprise an emitter and a light sensor. However, sensors with different constructions may be used.

Figure 4:
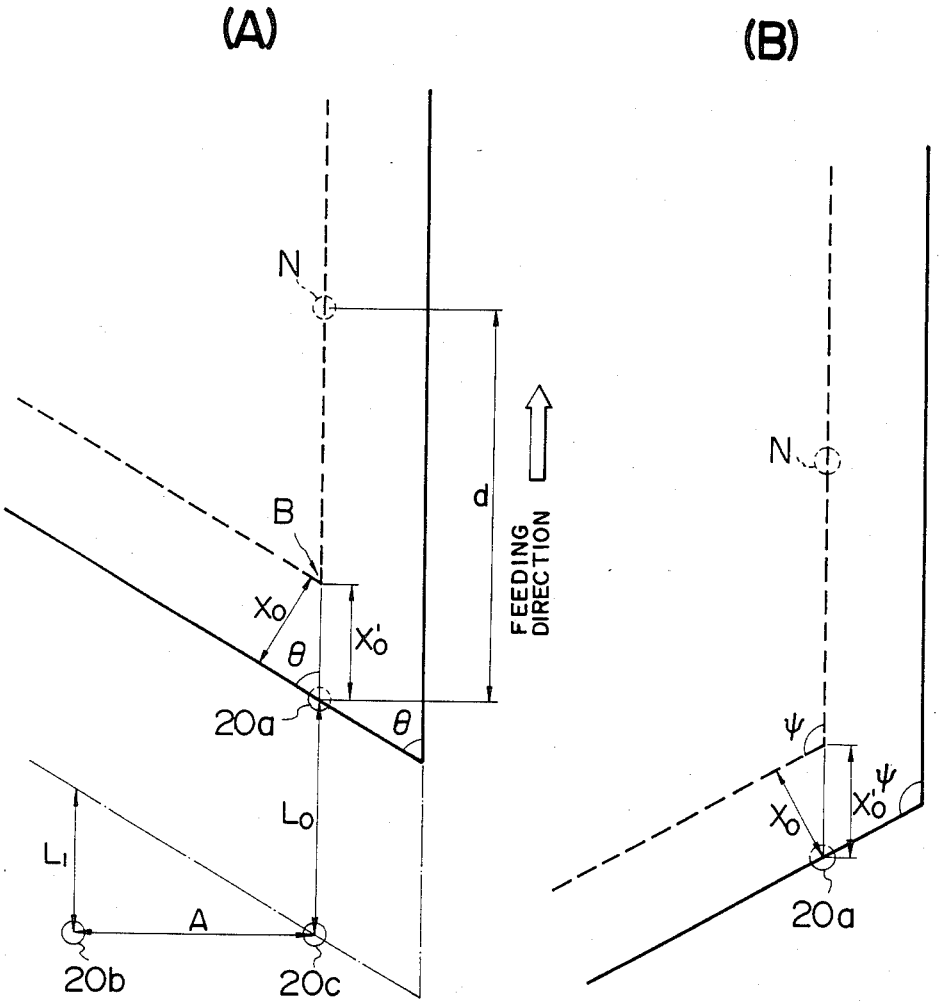
FIGS. 4A and 4B illustrate the respective positions of the photo sensors of the invention in relation to a needle hole and the direction of feeding the workpiece.

Referring to FIG. 4, photo sensor 20*c* is positioned on a line drawn from a needle hole N forward and in parallel with the line of feeding direction. Photo sensor 20*a* is positioned in between photo sensor 20*c* and the needle hole N. Photo sensor 20*b* is positioned on a line drawn from photo sensor 20*c* normally against the line connecting photo sensor 20*c* and the needle hole N. In the embodiment illustrated in FIG. 4(A), the line connecting photo sensors 20*b* and 20*c* is at a right angle with the line connecting photo sensors 20*a* and 20*c* and needle hole N.

Numeral 21 (FIGS. 1A and 1B) denotes a main shaft pulse generator which generates a main reference signal and may comprise an encoder provided at the main shaft 2 (FIG. 2). The encoder is provided to generate signals during the feeding process, and the pitch of the slits provided at the pulse generating disc corresponds to one basic unit of the feeding step.

Numeral 22 denotes a main shaft detector. During the feeding process, the main shaft detector generates a low (L) level signal. After the feeding process, the main shaft detector generates a high (H) level signal.

Numeral 23 denotes a first counter means which counts reference signals generated at the main shaft pulse generator 21 while the workpiece travels from photo sensor 20*b* to photo sensor 20*c*, the workpiece traveling in the direction of the arrow in FIG. 4. In this embodiment, the first counter 23 comprises an EXOR gate 23*a*, an AND gate 23*b* and a counter 23*c*.

Numeral 24 denotes a second counter means which counts reference signals generated while the workpiece travels from photo sensor 20*c* to photo sensor 20*a*. In this embodiment, the second counter comprises an inverter 24*a*, AND gates 24*b*, 24*c* and a counter 24*d*.

Numeral 25 denotes an operation means or circuit which calculates the stitch pitch from the numbers computed by the counters 23*c*, 24*d*. The operation circuit 25 calculates the required total stitch length after the photo sensor 20*a* has detected the end of the workpiece and converts the decimal portion of the adjusted stitch pitch in actual length.

Numeral 26 denotes a counter which counts the required number of stitchings after the photo sensor 20*a* has detected the end of the workpiece, by counting the pulse numbers from the main shaft pulse generator 21 via the AND gate 27. The counter 26, the AND gate 27, and the main shaft detector 22 constitute the first stitching means for stitching with a normal stitch pitch.

Numeral 28 denotes a driving circuit which rotates the stepping motor 18. Numeral 29 denotes a solenoid circuit which energizes the solenoid 15.

The rocking arm 11, the L-shaped lever 13, the operation lever 14, the solenoid 15, the actuator 15*a*, the connecting rod 16, the cam body 17, the stepping motor 18, and the potentiometer 19, constitute the second stitching means for stitching with a stitch pitch of less than the original stitch pitch.

Figure 8:
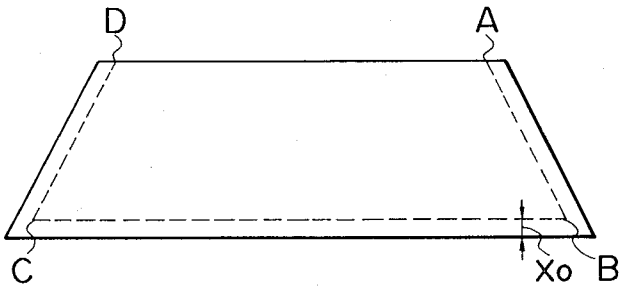
FIG. 8 illustrates an example of stitching a collar portion of a workpiece.

Referring to the flow chart of FIG. 6, one embodiment of the present invention will be explained. The embodiment to be described is a case of stitching a collar with a margin $X_0$ as shown in FIG. 8 from a point A to a point D, with a stitch pitch of $P_1$ (for example, 2 mm) and a margin SW (for example, $X_0=1$ mm). See flow chart of FIG. 6, step-1.

Figure 5:
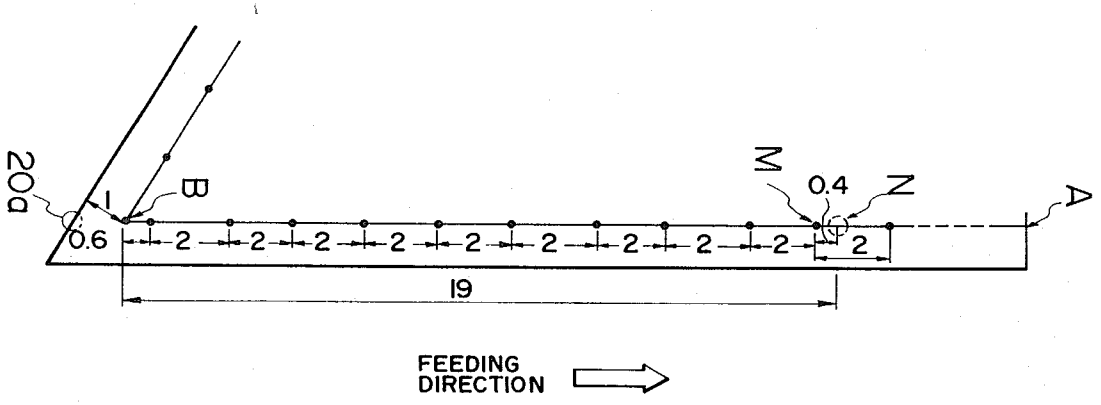
FIG. 5 illustrates one example of an actual feeding process according to the invention.

Referring to FIG. 4 and FIG. 5, the workpiece is fed as shown in direction of the arrow.

The end of the workpiece is detected by the photo sensors 20*a*, 20*b*, and 20*c* during feeding process in the order of 20*b*, 20*c*, 20*a*. When the end of the workpiece is detected first by the photo sensor 20*b* and then by photo sensor 20*c* (refer to FIG. 4A), the counter 23*c* counts the main shaft pulses outputted from the main shaft pulse generator 21, and outputs counted number $n_1$, during this travel, into the operation circuit 25 (refer to FIG. 7(*a*), (*c*), and (*d*)). When end of the workpiece is detected by the photo sensor 20*c* and then by photo sensor 20*a*, (See FIG. 6, step-1), the counter 24*d* counts the main shaft pulses outputted from the main shaft pulse generator 21 and outputs counted number $n_0$ into the operation circuit 25 (refer to FIG. 7 (*a*), (*b*), (*d*)).

The operation circuit 25, inputted with counted numbers $n_0$, $n_1$, calculates the distance ($X'_0$) between point B (FIG. 4) and the photo sensor 20*a* (refer to FIG. 4). The distance $X'_0$ is calculated as follows:

$$X_0' = X_0 \frac{\sqrt{\left(\frac{n_1}{n_0}\right)^2 L_0^2 + A^2}}{A} \quad (1)$$

In this formula (1), $X_0$ is the margin, $L_0$ is the distance between the sensor 20*a* and the sensor 20*c*, A is the distance between the sensor 20*b* and the sensor 20*c*, and the distance $L_1 = L_0 n_1 / n_0$.

The stitch pitch (pmm) can be expressed as follows:

$$P = \frac{L_0 \times N}{n_0} \quad (2)$$

where N in equation (2) refers to the number of main shaft pulse numbers per one stitch pitch.

Referring to FIG. 5, point M represents the first stitch point after the photo sensor 20a has detected end of workpiece.

The number of stitchings n from point M to point B with a stitch pitch P, in accordance with the invention, can be expressed as follows:

$$n = \frac{d - (X_0' + P_1)}{P} = \frac{d - X_0'}{P} - \frac{P_1}{P} = n' + a \quad (3)$$

In equation (3), d is the distance from the needle hole N to the point B (see FIG. 5), n' is an integer number, a is a fractional or decimal component such that $0<a<1$, and $P_1$ is the distance between the needle hole N and the point M. (See FIG. 5). $P_1$ can be thus found from the rotational angle of the main shaft which will be detected by the main shaft pulse generator 21.

Figure 1B:
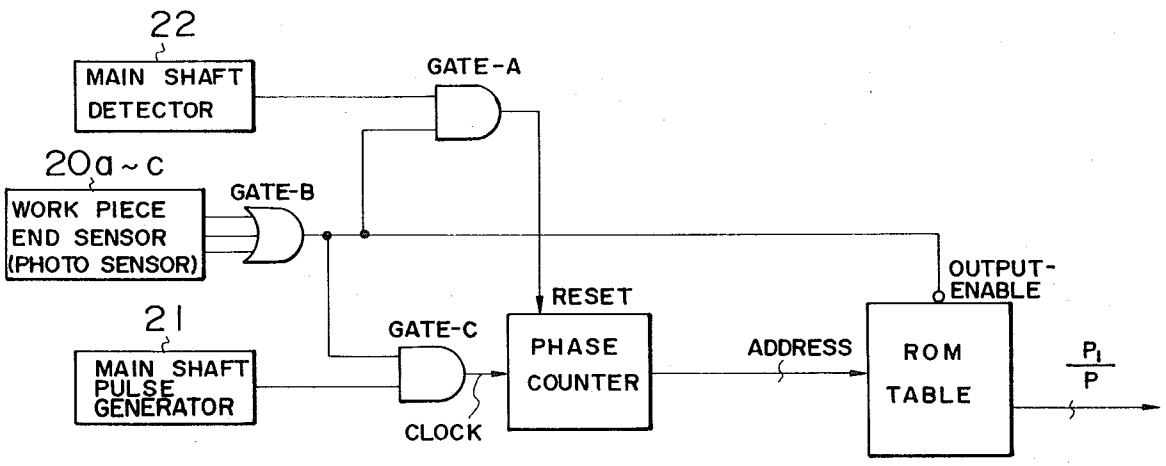
FIG. 1B is a block diagram showing how the value $P_1/P$ of FIG. 1A may be calculated.

When the workpiece is detected by the sensor 20a, referring to FIG. 1B, the main shaft detector 22 outputs a Low level (L) signal during the feeding process, and this signal is inputted into Gate-A. Photo sensors 20a, 20b and 20c are connected to the inverted input of AND Gate-A and to the input of AND Gate-C via OR Gate-B, while another output of the photo sensors is connected to an output-enable-input of a ROM table (see FIG. 1B).

A pulse train from the main shaft pulse generator 21 is inputted into the phase counter as a clock-signal via Gate-C. The phase counter detects the phase position of the main shaft when the photo sensor has detected the end of the workpiece. When the workpiece is covering the photo sensor and a High level H signal is outputted at Gate-B, the pulse train from the main shaft pulse generator 21 is inputted into the phase counter and the counter counts up since Gate-C is open. Under such condition, if the photo sensor has detected the end of the workpiece, the output changes from the High level H to the Low level L. Gate-C is then closed and the pulse train is not fed to the phase counter, and the counter stops.

As the output from Gate-B changes to Low L, although the feeding process is finished and the main shaft detector 22 outputs a High level H signal at that time, the phase counter is not reset, and the phase at the time the photo sensor detected the end of the workpiece is maintained.

The relation between the phase of the main shaft and the $P_1/P$ ratio is not linear but is curved and its curve is related to the stitch pitch. Thereby, to obtain the $P_1/P$ ratio from the main shaft phase, a table is required. In the embodiment herein, the phase value of the main shaft is fed to a ROM table as an address, and the parameter of the stitch pitch is fed into the address from the potentiometer through an A/D converter and latch. The parameter of the stitch pitch is latched when Gate-B changes from High level H to Low level L. The output from Gate-B is fed into the output-enable-input of the ROM table and when the photo sensor has detected the end of the workpiece, the ROM outputs $P_1/P$.

From the above formula (3), the number of stitchings with a stitch pitch P is n'. (See FIG. 6 step-4, step-5.)

The (n'+1)th stitch pitch Pl, the last stitch pitch to terminate at the predetermined point, is expressed as the following formula (see step-6):

$$Pl = p \times a \quad (4)$$

Responding to this Pl value, a stepping motor 18 is rotated by a motor driven circuit 28, and the cam body 17 rotates.

Referring to FIG. 5 as an example, if the number of stitching with normal stitch pitch P (for example 2 mm) is n', the adjusted stitch pitch Pl will be found from formula (3), substituting the following figures:

$d=20$ (mm) $X'_0=1$ (mm) $P_1=0.4$ (mm) $P=2$ (mm).

Then, $n=9.3=9+0.3=n'+a$; thereby $n'=9$ and $a=0.3$ are found.

Thereby, from formula (4), $Pl=2\times0.3=0.6$ (mm).

Figure 6:
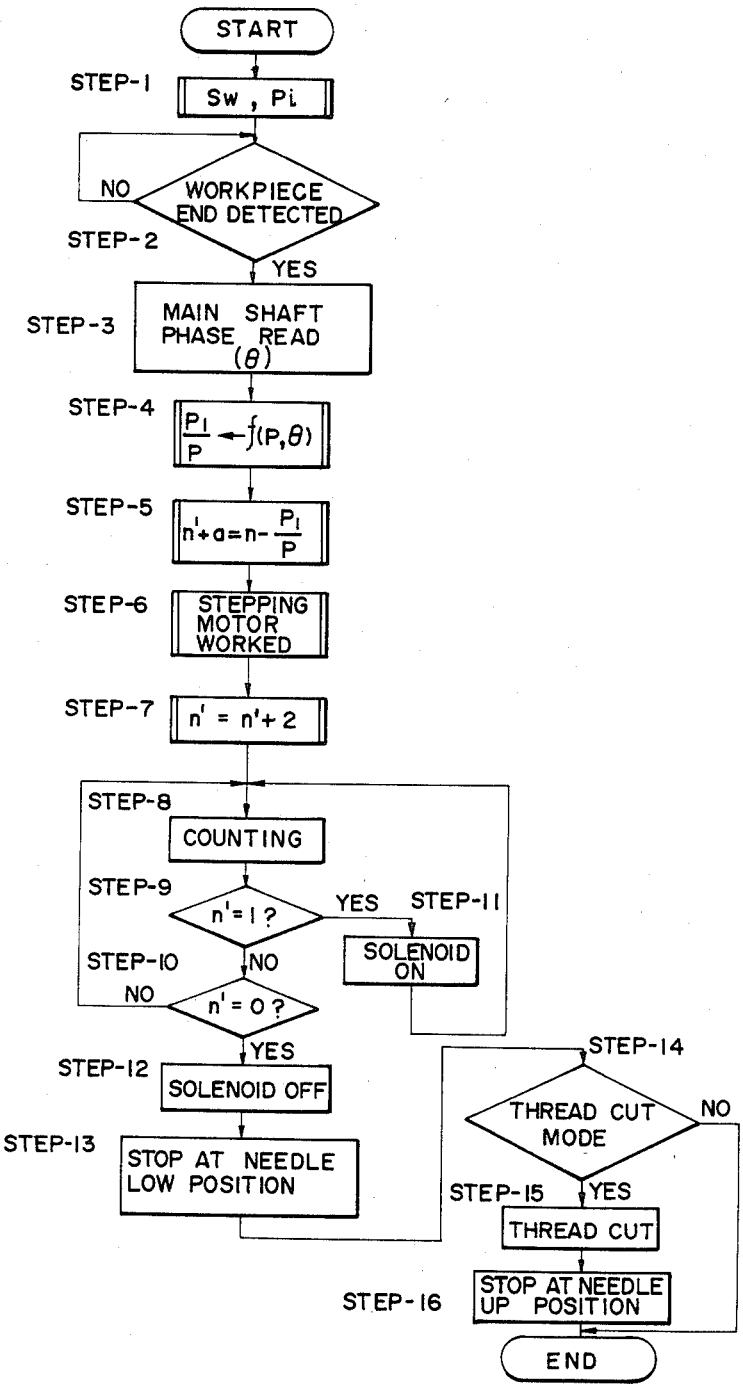
FIG. 6 is an operation flow-chart of an apparatus according to the invention.
Figure 7:
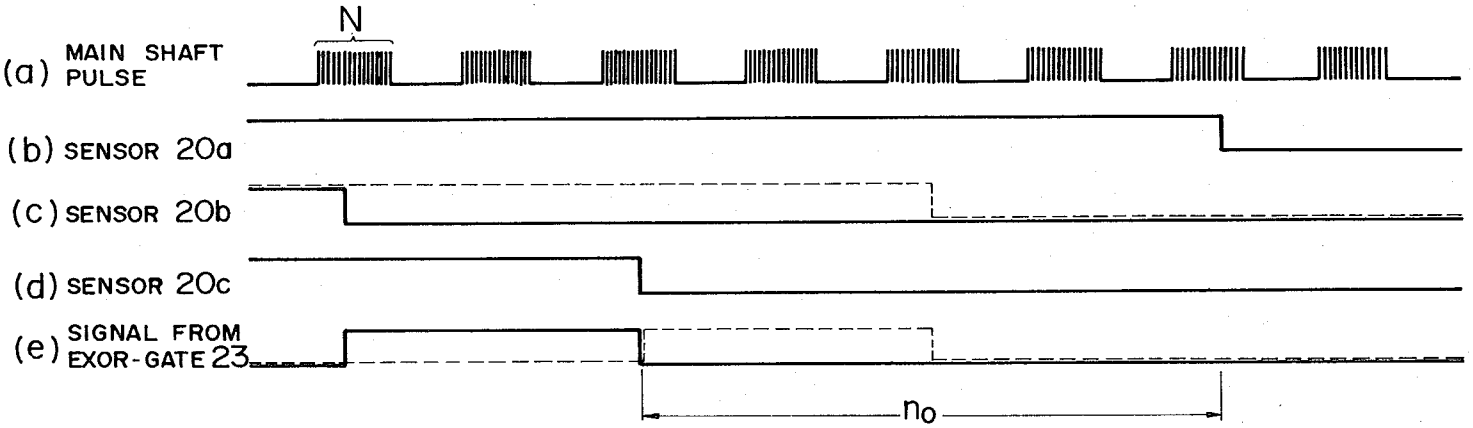
FIG. 7 illustrates signal waves of various components of the apparatus of FIG. 1.

When the photo sensor 20a has detected the end of workpiece, the required number of stitchings up to point B (refer to FIG. 5) are set into the counter 26, and this number is n'+2 (see FIG. 6, step-7). The counter 26 counts the number of stitchings outputted from the main shaft detector 22 (step-8), and when the counter has counted n'+1, the counter 26 inputs signals into the solenoid drive circuit 29 to energize the solenoid 15, and the solenoid acts upward (step-10) to draw the end 16a of the connecting lever 16 to the cam surface 17a. Thus, responding to this displacement of the end 16a, the adjusted last stitch pitch is performed. After the counter has counted n'+1, the machine stops (step-13). Then the stepping motor 18 restores to its home position, the solenoid 16 is denergized and the actuator 15a drops by its gravity (step-12), and the connecting lever resumes its original position.

Referring to FIG. 8, at point C, the same action as at point B is repeated, and at point D, after the stitching work is finished, the mode switches to the thread cut mode, and the thread is cut (step-14), (step-15). After cutting the thread, the machine stops (step-16).

As described above, according to the invention, the data derived by the photo sensors is used to calculate the number of stitchings with the normal pitch and with the adjusted stitch pitch. Thereby, regardless of the first stitch position, the last stitch position could be terminated at a predetermined position, keeping the constant predetermined margin distance $X_0$ as shown in FIG. 8.

As many apparently widely different embodiments of the invention may be made without departing from the spirit and scope thereof, it is to be understood that the invention is not limited to the specific embodiments herein described except as defined in the appended claims.

I claim:

1. An apparatus for automatically adjusting the stitch pitch of a sewing machine, comprising:

a first sensor for detecting the end of a workpiece positioned on a line drawn from a needle hole position parallel to the feeding line of the workpiece;

a second sensor for detecting the end of a workpiece positioned between said needle hole and said first sensor;

a third sensor for detecting the end of a workpiece postioned on a line drawn from the first sensor normally against the line connecting the needle hole and the first sensor;

a reference signal generator for generating reference signals relative to the rotation of the sewing machine main shaft;

first operating means for counting said reference signals during a time when a workpiece end is passing between said third sensor and said first sensor;

second operating means for counting said reference signals during a time when a workpiece end is passing between said first sensor to said second sensor;

stitch line length operating means for calculating the required stitch line length after said second sensor has detected said workpiece end, based on count numbers derived from said first and second operating means;

operating means adapted to determine the stitch pitch of a last stitch from a normal stitch pitch, the stitch line length and the decimal portion of a calculated number representing the required number of stitches which would be stitched at the normal stitch pitch to complete the line;

first means for stitching with said normal stitch pitch; and second means for stitching the last stitch with a stitch pitch of shorter than the normal stitch pitch.

2. An apparatus for automatically adjusting the stitch pitch of a sewing machine as recited in claim 1, wherein said stitch line length operating means calculates said required stitch line length according to the formula $$x_0' = x_0 \frac{\sqrt{(n_1/n_0)^2 L_0^2 + A^2}}{A}$$

wherein:

$x_0'$ is the distance between the needle hole and the last stitch point;

$x_0$ is the stitch margin;

$n_1$ is the number of reference signals counted by said first operating means;

$n_0$ is the number of reference signals counted by said second operating means;

$L_0$ is the distance between said second sensor and said first sensor; and

A is the distance between said third sensor and said first sensor.

3. An apparatus according to claim 1, wherein said second means includes a stepper motor rotating a cam, the position of said cam afffecting a drive length of a lever coupled to said first means, said lever affecting the amount of feed of a feed dog.

4. An apparatus for automatically adjusting the stitch pitch of a sewing machine, comprising:

means for determining an adjusted stitch pitch;

means responsive to said determining means for orientating a cam according to said adjusted stitch pitch;

a lever, one end of which travels in a direction towards said cam for engaging said cam and another end of which is rotatably connected to means for altering feed of a feed dog;

means for imparting motion to said one end in said direction towards said cam so as to cause said lever to engage said cam, the lever moving a distance before engaging the cam, the movement of said lever toward said cam rotating an arm of said altering means, said distance and the degree of rotation of said arm varying as a function of the orientation of said cam and the adjusted stith pitch;

said altering means altering the feed of said dog according to the rotation of said arm and the adjusted stitch pitch.

5. An apparatus according to claim 4, wherein said means responsive to said determining means comprises a stepping motor.

6. An apparatus according to claim 5, wherein said means for imparting motion comprises a solenoid.

7. An apparatus according to claim 4, further comprising means connected to said lever for restoring said lever to a home position.

8. A sewing machine having an automatic feeding apparatus for varying stitch pitch for a predetermined time in a sewing process, comprising:

a feed dog for feeding a workpiece in synchronism with rotation of a main drive shaft of the machine;

a rotatable regulator connected with the feed dog to regulate the amount of feed of the dog in response to the rotated position;

connecting means, movable within a predetermined range and connected with said regulator, for varying gradually the amount of feed of said dog in response to movement of the connecting means in one direction;

first driving means for moving said connecting means in said direction;

setting means engageable with the connecting means on the path of movement of the connecting means and displaceable from the engagement position in said direction;

second driving means for displacing said setting means;

a first circuit for operating the first driving means for a specified time;

a second circuit for operating the displacement of the second driving means to regulate the amount of feed varying when the first driving means is operative;

a third circuit for driving the first driving means during the time of operation of the first circuit and for driving the second driving means to displace the setting means to the position which is operated by the second circuit before this time of operation.

9. An apparatus for adjusting the stitch pitch of a sewing machine, comprising:

a feed dog which feeds a workpiece;

an action shaft which is rotated to adjust the feed of the feed dog;

first driving means for rotating said action shaft to regulate the feed pitch;

engaging means attached to an end of said action shaft and rotating therewith;

stopping means engageable with said engaging means; and second driving means for moving said stopping means in degrees so as to variably alter the distance between said engaging means and said stopping means;

said apparatus being adapted such that after said second driving means has caused said stopping means to be positioned at a predetermined position, said first driving means causes said engaging means to travel said distance and engage with the stopping means, said travel distance affecting the feed pitch.

10. An apparatus according to claim 9, wherein said first driving means is a solenoid and said second driving means is a stepping motor.

11. An apparatus according to claim 10, further comprising means for determining an adjusted stitch pitch, and wherein said second driving means is responsive to said determining means and moves said stopping means as a function of said adjusted stitch pitch.

12. An apparatus for setting an adjusted stitch pitch in a sewing machine, comprising:

means for detecting the end of a workpiece;

control means responsive to said detecting means and adapted to calculate an adjusted stitch pitch for stitching a last stitch at a predetermined point;

first driving means responsive to said control means for rotating a cam in degrees relative to said adjusted stitch pitch at a pre-determined time;

second driving means for moving a lever in the direction of said cam such that said lever engages said cam;

the rotation of said cam changing the distance between said cam and said lever, the movement of said lever effecting the adjustment in the stitch pitch.

13. An apparatus according to claim 11, wherein said first driving means is a stepping motor and said second driving means is a solenoid.

* * * * *